United States Patent [19]

Khanna et al.

[11] Patent Number: 4,930,978

[45] Date of Patent: Jun. 5, 1990

[54] COMPRESSOR STAGE WITH MULTIPLE VENTED INDUCER SHROUD

[75] Inventors: Jai K. Khanna, Indianapolis; Norman G. Silvey, Greenfield; Charles D. Williams, Indianapolis, all of Ind.

[73] Assignee: Household Manufacturing, Inc., Prospect Heights, Ill.

[21] Appl. No.: 214,281

[22] Filed: Jul. 1, 1988

[51] Int. Cl.[5] ..... F04D 29/42

[52] U.S. Cl. ..... 415/58.3; 415/914

[58] Field of Search ..... 415/52.1, 58.2, 58.3, 415/58.4, 144, 145, 206, 116, 914

[56] References Cited

U.S. PATENT DOCUMENTS

| | | | |
|---|---|---|---|
| 2,656,096 | 10/1953 | Schwartz | 415/144 X |
| 2,698,711 | 1/1955 | Newcomb | 415/145 |
| 3,217,655 | 11/1965 | Sercy et al. | 415/144 |
| 3,218,029 | 11/1965 | Woollenweber, Jr. | 415/206 |
| 3,292,845 | 12/1966 | Hens et al. | 415/1 |
| 3,408,046 | 10/1968 | Woollenweber, Jr. | 415/206 |
| 3,426,964 | 2/1969 | Silvern | 415/158 |
| 3,504,986 | 4/1970 | Jackson | 415/58.5 |
| 3,887,295 | 6/1975 | Yu | 415/116 |
| 3,901,620 | 8/1975 | Boyce | 415/1 |
| 3,976,390 | 8/1976 | Silvern et al. | 415/58.1 |
| 4,063,848 | 12/1977 | Wiggins et al. | 415/206 |
| 4,116,171 | 9/1978 | Schulmeister et al. | 415/58.2 |
| 4,212,585 | 7/1980 | Swarden et al. | 415/58.6 |
| 4,248,566 | 2/1981 | Chapman et al. | 415/914 |
| 4,256,441 | 3/1981 | Arora | 417/407 |
| 4,375,938 | 3/1983 | Dussourd | 415/58.5 |
| 4,512,715 | 4/1985 | Cohn et al. | 415/144 X |
| 4,743,161 | 5/1988 | Fisher et al. | 415/58.4 |
| 4,781,530 | 11/1988 | Lauterbach et al. | 415/914 X |

FOREIGN PATENT DOCUMENTS

| | | | |
|---|---|---|---|
| 963540 | 7/1950 | France | 415/58.3 |
| 55-35173 | 3/1980 | Japan | 415/914 |

OTHER PUBLICATIONS

Article entitled "Experimental Determination of the Reverse Flow Onset in a Centrifugal Impeller", Authors: Jean Paul Barrand, et al., pp. 63–71.

Article entitled "Control of Backflow at the Inlets of Centrifugal Pumps and Inducers": Authors: Donald P. Sloteman et al., pp. 9–22, drwgs. attached (3).

Publication entitled: "SAE Technical Paper Series—Application of Map Width Enhancement Devices to Turbocharger Compressor Stages", Author: F. B. Fisher, Dated: Apr. 12–14, 1988, pp. 1–8.

*Primary Examiner*—Robert E. Garrett
*Assistant Examiner*—John T. Kwon
*Attorney, Agent, or Firm*—Woodard, Emhardt, Naughton, Moriarty & McNett

[57] ABSTRACT

A compressor stage or a turbocharger having a compressor stage having an inducer shroud with two or more vents. A first vent is provided with a second vent upstream thereof, allowing for outflow during surge conditions and inflow during choking conditions. Surge line characteristics may be varied by selectively locating the position of the first and of the second vents, and by selectively determining the effective width of the vents. The vents may be circumferential slots, and may be slanted. An outer shroud is provided forming a venting chamber for recirculation of gas into the gas intake. A third vent may be provided to vent the diffuser.

30 Claims, 7 Drawing Sheets

| TEST | $\alpha_1$ | $\beta_1$ | $\alpha_2$ | $\beta_2$ |
|---|---|---|---|---|
| A | .1111 | .030 | .0139 | .020 |
| B | .1111 | .030 | – | – |
| C | .0139 | .020 | – | – |
| D | – | – | – | – |

| TEST | $\alpha_1$ | $\beta_1$ | $\alpha_2$ | $\beta_2$ |
|---|---|---|---|---|
| A | .1111 | .030 | .0139 | .020 |
| E | .0624 | .040 | -.0343 | .030 |
| F | .0694 | .030 | -.0343 | .030 |
| G | .0765 | .020 | .0139 | .030 |
| H | .0139 | .030 | -.0343 | .030 |

FOR COMPRESSOR TOTAL PRESSURE RATIO OF 2.0 : 1.0

| TEST | 601 FIRST VENT | | 604 SECOND VENT | | 605 CHOKE/ SURGE | 606 CHOKE/ SPINE | 607 SPINE/ SURGE | 608 CHOKE FLOW | 609 SURGE FLOW | 610 ΔM = CHOKE - SURGE KG /SEC X 100 | 611 PERCENT IMPROVEMENT IN FLOW RANGE |
|---|---|---|---|---|---|---|---|---|---|---|---|
| | $\alpha_1$ | $\beta_1$ | $\alpha_2$ | $\beta_2$ | | | | | | | |
| A | .1111 | .030 | .0139 | .020 | 2.99 | 1.37 | 2.19 | 43.0 | 14.40 | 28.6 | 36.2 |
| B | .1111 | .030 | – | – | 2.62 | 1.48 | 1.76 | 44.5 | 17.0 | 27.5 | 30.9 |
| C | .0139 | .020 | – | – | 2.20 | 1.57 | 1.40 | 44.0 | 20.0 | 24.0 | 14.3 |
| D | – | – | – | – | 1.91 | 1.53 | 1.25 | 44.0 | 23.0 | 21.0 | – |
| E | .0624 | .040 | -.0343 | .030 | 2.89 | 1.42 | 2.04 | 43.4 | 15.0 | 28.40 | 35.2 |
| F | .0694 | .030 | -.0343 | .030 | 2.48 | 1.69 | 1.46 | 44.0 | 17.75 | 26.25 | 25.0 |
| G | .0765 | .020 | .0139 | .030 | 2.90 | 1.45 | 2.00 | 43.5 | 15.0 | 28.5 | 35.7 |
| H | .0139 | .030 | -.0343 | .030 | 2.39 | 1.59 | 1.50 | 43.0 | 18.0 | 25.0 | 19.0 |

Fig.6

COMPRESSOR STAGE WITH MULTIPLE VENTED INDUCER SHROUD

BACKGROUND OF THE INVENTION

This invention relates generally to compressor stages, and more specifically to a compressor stage having inducer vents.

Compressor stages, such as those used for engine turbocharging, experience surge and choking at various mass flow rates. Surge generally occurs as the compressor stage starts to experience violent instability or flow reversals. Conversely, choking generally occurs as the maximum mass flow rate through the compressor stage passes at a certain compressor speed. This maximum flow is considered below the sixty-eight percent efficiency in the present day technology. The surge line and the choke line are typically plotted on a pressure ratio-mass flow rate graph known as a compressor map. A compressor map illustrates the range in which a given compressor design may operate without surge or choking.

The parameters that determine the onset or the start of a stall or a surge in a compressor stage are the blade shape of the impeller, the inducer diameter of the impeller, the tip width of the discharge or trailing edge of the impeller, the diffuser width, the shape and size of the volute, and the surface roughness of the surfaces of the diffuser, volute, and associated passages. Reverse flow initiated because of stall traverses back all the way to the inducer and even farther away from the inducer.

It is desirable to enlarge the range of operation (or map width) of a compressor mainly before surge occurs to improve compressor performance, particularly for certain demanding applications. Performance improvements may include expanding the range of conditions and speeds in which the compressor will operate, increasing efficiency, increasing available power, and decreasing the air noise regime associated with surge phenomenon.

One approach that has been used to address this problem has been to provide a bidirectional bleed hole or vent located in the inducer shroud of the compressor. This bleed slot (or series of circumferentially aligned holes, or single circumferential slot) acts to allow an inflow of air during what would otherwise be choke conditions, and acts to allow an outflow of air during what would otherwise be surge conditions. The result, when plotted on a compressor map, is to shift the surge line to the left on the compressor map and/or to shift the choke line to the right on the compressor map. Thus, the range of operation between compressor stage surge and choke is enlarged.

The present invention significantly enlarges the range of operation between compressor stage surge and choke beyond prior techniques. The present invention especially improves the surge characteristics of a compressor. Furthermore, the present invention affords compressor designers greater latitude in dictating the surge line profile and/or choke line profile for a given compressor design. Thus, compressor designers may, for a particular application, better tailor compressor surge characteristics to suit the particular application. Accordingly, the present invention is a significant advance in the compressor art.

The present invention accomplishes these advantages by including multiple location bleed holes along the inducer and contour of the compressor stage. By selectively locating these bleed holes with respect to the leading edge of the impeller blades, and with respect to each other, and by selectively determining the width of these holes, significant surge line movement can be obtained. By selectively determining the size of these bleed holes (slots in the preferred embodiment), surge lines can be contoured to ones needs.

SUMMARY OF THE INVENTION

According to one embodiment, the present invention provides a gas compressor stage comprising an impeller including a blade, the blade having a leading edge, an outward free edge and a trailing edge; means for driving the impeller; a compressor housing having a gas intake and a gas diffuser passageway downstream thereof, the impeller being located in the housing along a gas flow path between the gas intake and the gas diffuser passageway, wherein the housing includes a shroud wall upstream of the gas diffuser passageway and having an internal shroud surface in close proximity to the radially outward free edge of the blade; a first vent in the shroud wall being located in the shroud wall upstream of the trailing edge of the impeller; and a second vent in the shroud wall being located in the shroud wall upstream of the first vent.

According to another embodiment, the present invention also provides a turbocharger having a gas compressor stage comprising: an impeller including a hub, a blade, the blade having a leading edge, an outward free edge and a trailing edge; turbine means operably couplable to an exhaust of an internal combustion engine for driving the impeller; a compressor housing having a gas intake and a gas diffuser passageway downstream thereof, the diffuser passageway being operably couplable to an air intake of the internal combustion engine, the impeller being located in the housing along a gas flow path between the gas intake and the gas diffuser passageway, wherein the housing includes a shroud wall upstream of the gas diffuser passageway, and having an internal shroud surface in close proximity to the radially outward free edge of the blade, wherein the impeller defines a meridional path between the hub and the radially outward free edge, wherein the meridional path intersects with the leading edge of the impeller to define a meridional datum, and wherein the meridional path intersects with the trailing edge to define a high pressure datum; first venting means in the shroud wall for allowing gas flow through the shroud wall, the first venting means being located in the shroud wall upstream of the high pressure datum; and second venting means in the shroud wall for allowing gas flow through the shroud wall, the second venting means being located in the shroud wall upstream of the first venting means.

The present invention also provides a gas compressor stage comprising: an impeller including a hub, a blade, the blade having a leading edge, an outward free edge and a trailing edge; means for driving the impeller; a compressor housing having a gas intake and a gas diffuser passageway downstream thereof, the impeller being located in the housing along a gas flow path between the gas intake and the gas diffuser passageway, wherein the housing includes a shroud wall upstream of the gas diffuser passageway and having an internal shroud surface in close proximity to the radially outward free edge of the blade, wherein the impeller defines a meridionial path between the hub and the radially outward free edge, wherein the meridional path intersects with the leading edge of the impeller to define a meridional datum, and wherein the meridional path intersects with the trailing edge to define a high pressure datum, the impeller defining an inducer diameter at the meridional datum and an outer diameter at the high pressure datum; first venting means in the shroud wall being located in the shroud wall upstream of the high pressure datum, wherein the first venting means has a first effective vent width and is located a first meridional vent distance from the meridional datum, wherein the ratio between the first meridional vent distance and the outside diameter is between 0.01:1.00 and 0.15:1.00, and wherein the ratio between the first effective vent width and the inducer diameter is between 0.01:1.00 and 0.05:1.00; and second venting means in the shroud wall for allowing gas flow through the shroud wall, the second venting means being located in the wall upstream of the first venting means, wherein the second venting means has a second effective vent width and is located a second meridional vent distance from the meridional datum, wherein the ratio between the second meridional vent distance and the outside diameter is between −0.04:1.00 and 0.015:1.00, and wherein the ratio between the second effective vent width and the inducer diameter is between 0.01:1.00 and 0.04:1.00.

An object of the present invention is to provide a compressor stage having a multiple vented inducer shroud.

Another object of the present invention is to provide a compressor stage and to provide a turbocharger having a compressor stage with improved performance.

Another object of the present invention is to provide a compressor stage having improved surge characteristics.

Another object of the present invention is to provide increased flow capability near choke conditions.

Another object of the present invention is to provide a compressor stage having stabilizing flow at the surge line, decreased noise of unstable air flow, and increased efficiency.

Another object of the present invention is to provide a compressor stage suited to having a selected surge profile characteristic designed therein.

Another object of the present invention is to provide a compressor stage having reduced air noise next to the surge line.

Related objects and advantages of the present invention are disclosed in the following description of the preferred embodiments.

BRIEF DESCRIPTION OF THE DRAWINGS

FIG. 6 is a table showing selected characteristics of various compressor stages.

DESCRIPTION OF THE PREFERRED EMBODIMENTS

Figure 1:
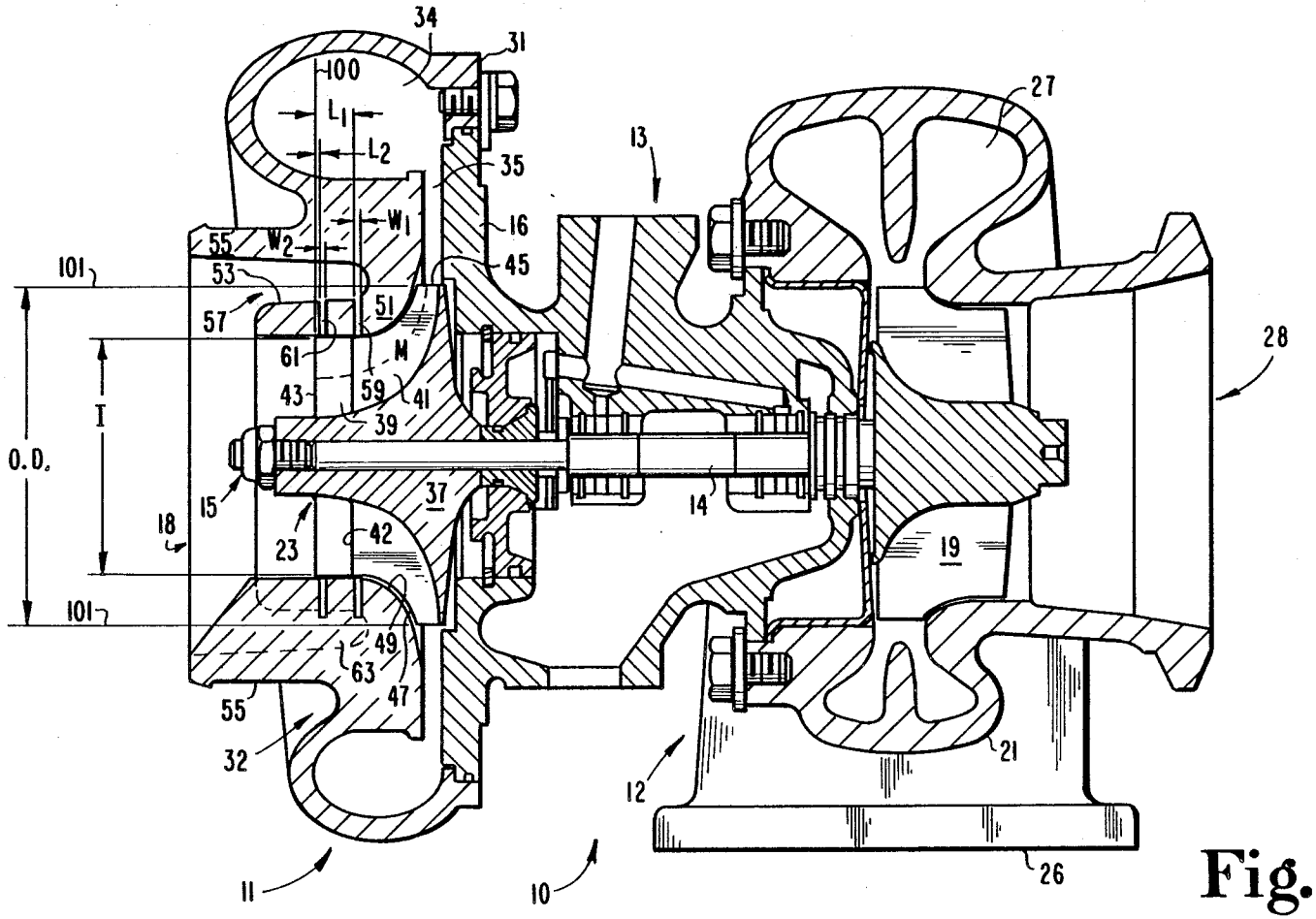
FIG. 1 is a side, cross-sectional view of one embodiment of a turbocharger having a compressor stage according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
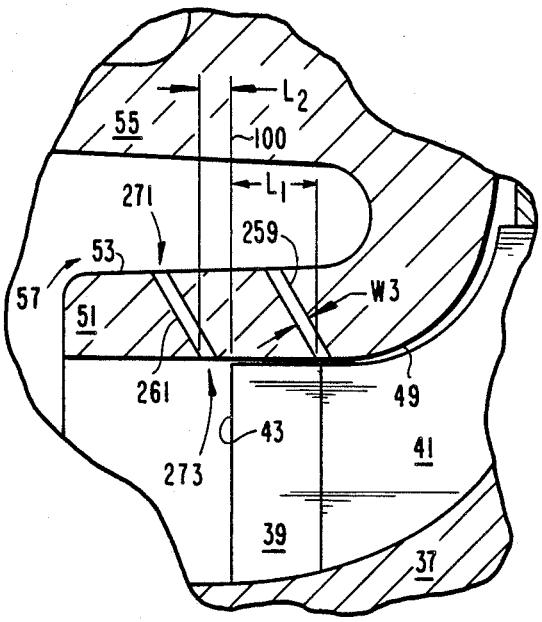
FIG. 2 is a partial side, cross sectional view of a second embodiment of a turbocharger having a compressor stage according to the present invention.

Referring now to FIGS. 1 and 2 there is shown a turbocharger assembly 10 including a compressor stage assembly 11 and a turbine stage assembly 12. Bearing housing assembly 13 supports and inter-connects the compressor stage assembly 11 and the turbine stage assembly 12. Assembly 13 includes a shaft 14, rotatable on a common axis.

Exhaust gas from the exhaust manifold of an internal combustion engine to which turbocharger 10 is connected enters turbine housing 21 through turbine inlet 26 and thereafter enters volute 27. The gas enters the turbine wheel 19 around its periphery and expands through the turbine and discharges through the exhaust outlet 28. Energy of the exhaust gas is thereby converted to mechanical work, turning turbine wheel 19 and driving shaft 14 and impeller 23. The impeller 23 is used to compress air to increase the amount of air delivered to the engine cylinders above that available in natural aspiration. The compressed air exits compressor stage 11 through a tangential outlet communicating with passageway 34 and connected to the engine intake manifold or air induction system. As a result, the engine burns more fuel and produces greater power.

Impeller 23 is mounted upon stub-shaft of shaft 14 and retained by a lock nut 15 and is operable to rotate therewith. Compressor cover 31 is attached to bearing housing 16 and together they define a compressor housing 32 having an impeller chamber therein. Compressor cover 31 in conjunction with bearing housing 16 defines annular diffuser passageway 35. Upon rotation of impeller 23, the fluid to be pressurized is drawn inwardly from an inlet system which includes an inlet pipe (not shown) into gas intake 18 of the compressor and is propelled along a flow path through diffuser passageway 35 into the volute, outlet passageway 34. The inlet pipe is operably coupled to gas intake 18 to provide filtered gas to be compressed as is known in the art.

Impeller 23 includes impeller hub 37 having impeller blades mounted thereon. As illustrated, these blades include blades 39 and splitter blades 41. However, the present invention does not necessarily require the use of splitter blades. Blades 39 have a leading edge 43, a trailing edge 45, and an outward free edge 47. Outward free edge 47 is in close proximity to internal shroud surface 49 of shroud wall 51, the free edge 47 and shroud surface 49 having closely conforming profiles. Splitter blades 41 also have a leading edge such as at 42. Shroud wall 51 further has an external shroud surface 53. Furthermore, there is an outer shroud 55 which is annularly positioned around shroud wall 51 and around external shroud surface 53. Venting chamber 57 is defined between outer shroud 55 and external shroud surface 53 of shroud wall 51.

Shroud wall 51 has a first vent 59 and a second vent 61 located therein. In the preferred embodiment, each of vents 59 and 61 is a circumferential slot machined through shroud wall 51. The slots are bridged by preferably at least three aerodynamic struts, such as strut 63. When three struts are used, they are located at approximate 120° intervals around the circumference of shroud wall 51. In this way, the three longitudinal subsections of shroud wall 51, as illustrated in FIG. 1, are fixed with respect to one another. As alternatives (not shown), slots may be replaced by a plurality of radial bores or other bleed holes through shroud wall 51, such as axial holes intersected by angled holes in the inducer.

First vent 59 and second vent 61 communicate venting chamber 57 with the impeller chamber. Both of these vents have been found to improve the surge characteristics of the compressors tested. In the proximity of surge conditions, a stream of heated and pressurized gas backflows in an upstream direction away from trailing edge 45. This backflow occurs near and along internal shroud surface 49. First vent 59, in the proximity of surge conditions, provides a vent flow path for such heated and pressurized gas to flow into venting chamber 57 and be recirculated to gas intake 18. Furthermore, second vent 61 provides an additional vent for heated and pressurized gas not vented through first vent 59 to communicate with venting chamber 57. By providing the two vent configuration, improved surge characteristics can be obtained over similar devices having only one vent. Furthermore, by varying the location and effective width of the vents, the surge line profile may be altered to suit a particular design application. Thus, with the two vents, one has greater latitude in designing a compressor stage to have particular surge characteristics.

The location and effective width of first vent 59 and second vent 61 are preferably defined as follows. The meridional path, designated as "M" in FIG. 1, is defined as the flow path through the compressor beginning upstream at leading edge 43 and running halfway between hub 37 and radially outward free edge 47. Meridional path M runs downstream back to and ending at trailing edge 45. There is a meridional datum 100 defined as the plane where meridional path M intersects leading edge 43 of the impeller. Similarly, there is a high pressure datum 101 defined as the cylinder where meridional path M intersects trailing edge 45. Note that meridional datum 100 coincides with leading edge 43 since leading edge 43 is perpendicular to the axis of rotation of shaft 14. However, various embodiments may be employed in which leading edge 43 is tapered backwardly or curvilinear, in which case meridional datum 100 would not completely coincide with the leading edge. Similarly, although trailing edge 45 coincides with high pressure datum 101, it would be possible to vary the profile of trailing edge 45 so as not to coincide with high pressure datum 101.

The effective width of first vent 59 is denoted as $W_1$. Likewise, the effective width of second vent 61 is denoted as $W_2$.

The location of first vent 59 and second vent 61 is defined in relation to meridional datum 100. First vent 59 is located first length $L_1$ from meridional datum 100. Second vent 61 is located second length $L_2$ from meridional datum 100. These lengths are taken from the respective upstream sides of vents 59 and 61. First length $L_1$ and second length $L_2$ may fall within preferred ranges in the present invention. These ranges may be expressed as a percentage of the length of a path taken from meridional datum 100 to high pressure datum 101 along internal shroud surface 49. Typically, first length $L_1$ is between 25 and 35% of such length along internal shroud surface 49, and is more typically about 30% of such length. Second length $L_2$ typically ranges between −5% and 15% of such length, and is most typically equal to zero, or in other words, near meridional datum 100. Second length $L_2$ may be expressed as a negative value (or accordingly, a negative percentage) representing that second vent 61 is upstream of the meridional datum 100.

However, slot 59 may be located from zero to forty percent (40%) of the meridional distance from the leading edge 43 of the blade; and vent 61 may be located from negative ten percent (−10%) to thirty percent (30%) of the meridional distance from the leading edge 43 of the blade. The widths of the two vent slots can be equal or unequal, depending on their location with respect to each other.

The position and effective width of first vent 59 and second vent 61 may be further defined in terms of ratiometric relationships. More specifically, lengths $L_1$ and $L_2$, and widths $W_1$ and $W_2$, may be stated ratiometrically in terms of inducer or impeller diameters. As illustrated in FIG. 1, impeller 23 has an inducer diameter, designated as "I". Inducer diameter "I" is the outermost diameter of blades 39 taken at meridional datum 100. Similarly, the outside diameter of the impeller, designated as "O.D.", is the diameter of high pressure datum 101. The location of the openings of first vent 59 and second vent 61 may be defined as the ratio between the respective length, $L_1$ or $L_2$, to outside diameter "O.D.". The size of first vent 59 or second vent 61 may be expressed as the ratio of the respective effective vent width, $W_1$ or $W_2$, to inducer diameter "I". Thus, these ratios, denoted $\alpha$ and $\beta$, are determined by the following equations:

$$\alpha_1 = \frac{L_1}{O.D.}$$

$$\beta_1 = \frac{W_1}{I}$$

$$\alpha_2 = \frac{L_2}{O.D.}$$

$$\beta_2 = \frac{W_2}{I}$$

When the compressor stage is operating near the surge, a majority of the reverse flow traverses back through the first slot 59 and most of the remaining backflow then passes through the second slot 61 into venting chamber 57 and back again into the impeller.

Figure 3:
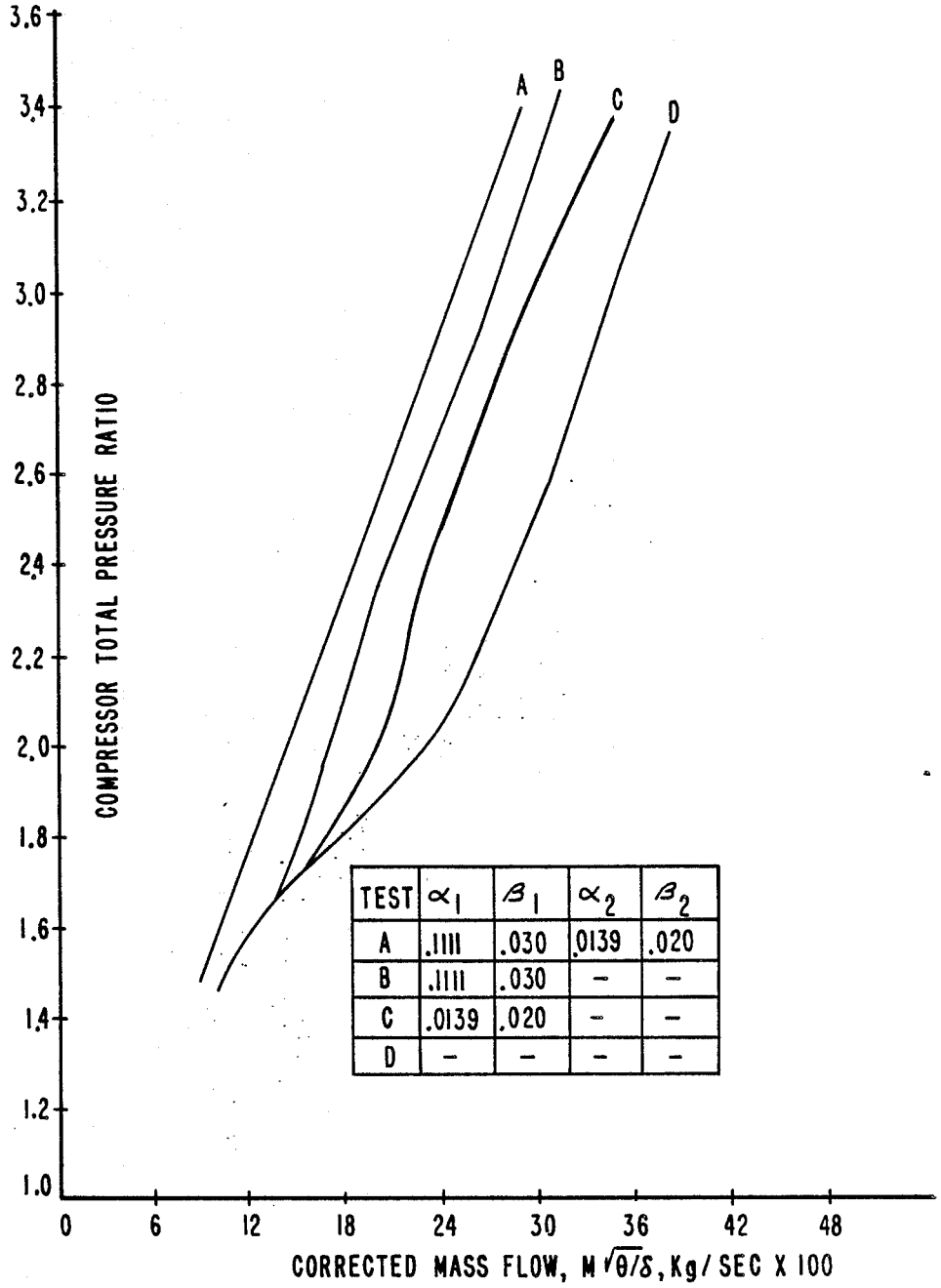
FIG. 3 is a compressor map illustrating the surge line for a compressor stage embodying the present invention superimposed on surge lines of compressor stages not embodying the present invention.

FIG. 3 illustrates the surge lines of four compressor designs identified as A, B, C and D. Also, superimposed on the graph of FIG. 3 is a table setting forth the ratios $\alpha_1$, $\beta_1$, $\alpha_2$, and $\beta_2$ for each of the four compressor designs, A, B, C and D. Note that of these four designs, only compressor A has both a first vent and a second vent according to the present invention. Accordingly, compressor A, unlike the other compressors B, C and D, has values for each of the ratios $\alpha_1$, $\beta_1$, $\alpha_2$, and $\beta_2$.

Compressor design D is the same as compressor design A, except compressor D does not have any vents in the shroud. Compressor design C has one vent at a location $\alpha_1$ and with a width $\beta_1$. Compressor design B likewise has only one vent at a location $\alpha_1$ and with a width $\beta_1$. As shown in FIG. 3, compressor designs B and C jointly have the same $\alpha$ and $\beta$ ratios as compressor design A.

The surge lines plotted in FIG. 3 illustrate that the two vent compressor A in accordance with the present invention has superior surge characteristics over the single vent designs, B and C, and the no vent design D.

Figure 4:
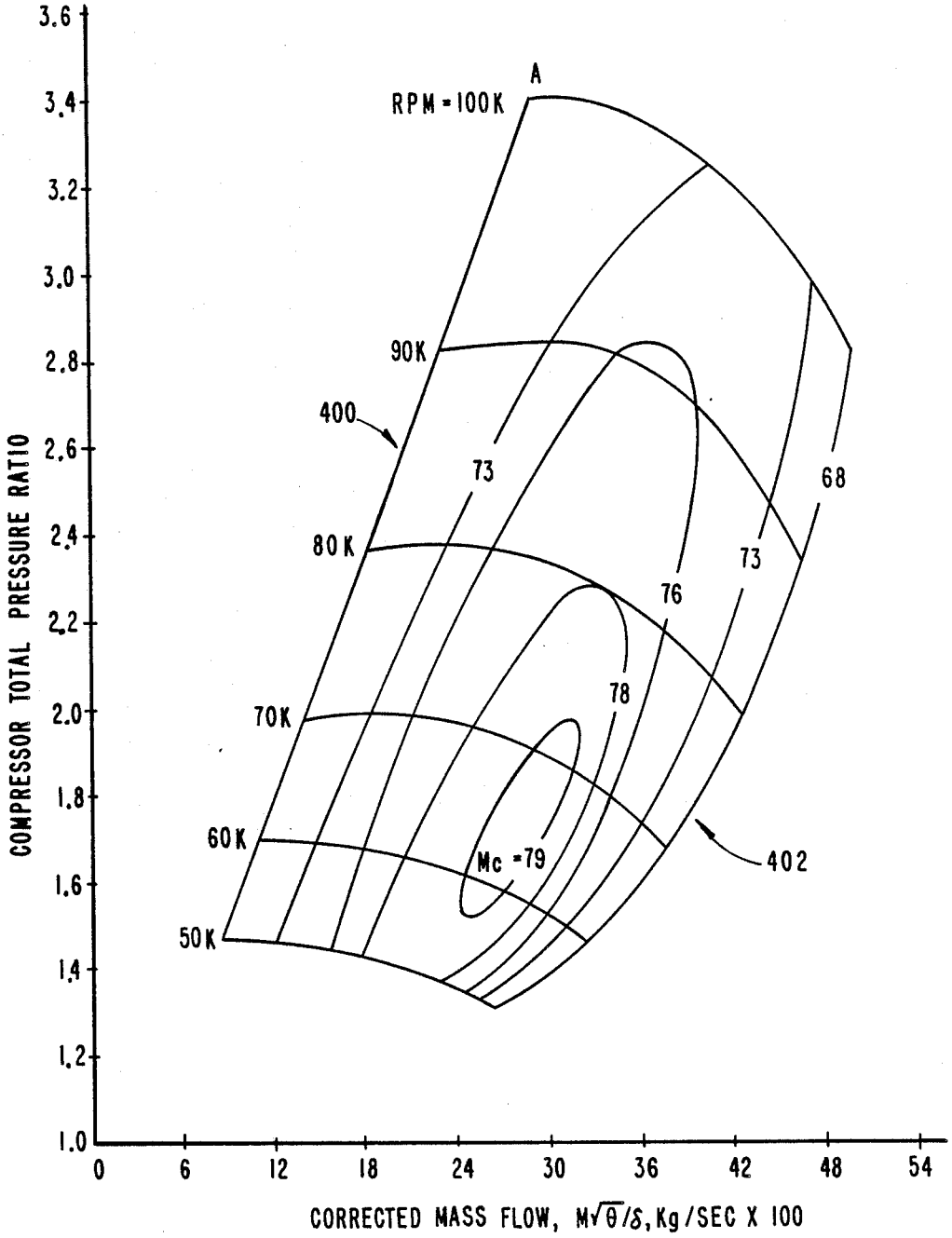
FIG. 4 is a compressor map for a compressor stage embodying the present invention.

Referring now to FIG. 4, the compressor map for compressor design A is shown. The surge line shown at 400 is the same as the surge line for compressor design A plotted in FIG. 3. Furthermore, choke line 402 is plotted in FIG. 4 to the right of surge line 400. Note that FIG. 4 plots compressor performance along lines defining revolutionary speeds of 50,000–100,000 rpm, designated progressively as 50K, 60K, 70K, 80K, 90K and 100K. Furthermore, FIG. 4 plots efficiency islands for compressor design A for values of 68%, 73%, 76%, 78% and 79%.

Figure 5:
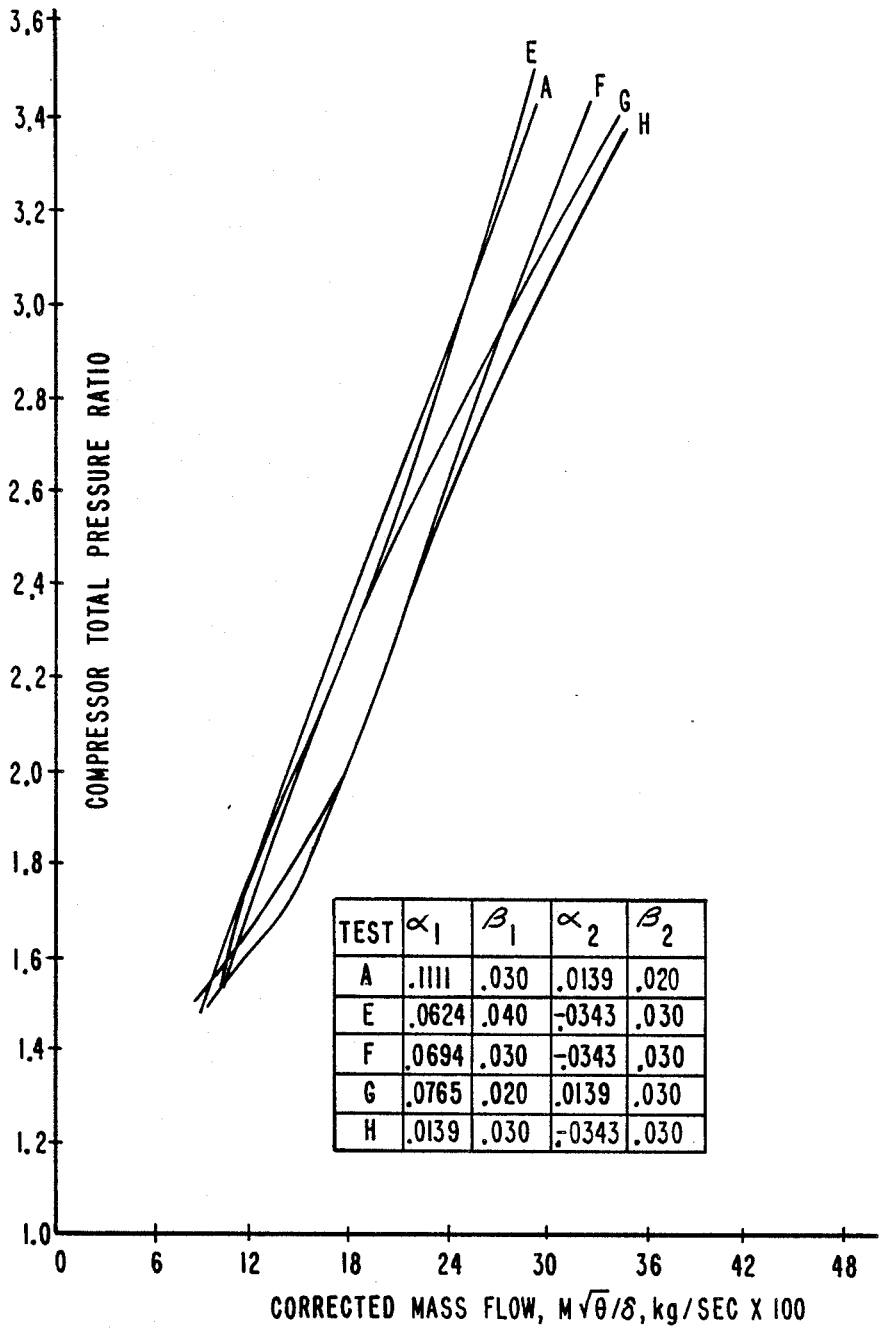
FIG. 5 is a compressor map illustrating surge lines of various embodiments of compressor stages according to the present invention.

Referring now to FIG. 5, surge lines of various embodiments of the present invention are plotted. Compressor design A is the same as described above in conjunction with FIGS. 3 and 4. Compressor designs E, F, G and H each have a first vent and a second vent according to the present invention as well. As shown in the table superimposed on FIG. 5, each of these compressor designs (A, E, F, G and H) have values for $\alpha_1$, $\beta_1$, $\alpha_2$, and $\beta_2$, denoting that two vents are present. Note that in compressor designs E, F, and H, the value for $\alpha_2$ is negative, denoting that the position of second vent 61 (see FIG. 2) is upstream of meridional datum 100. The five various compressor embodiments illustrated in FIG. 5 have distinct surge line profiles. Furthermore, these five surge line profiles may differ from surge line profiles of compressors not embodying the present invention, such as plotted in FIG. 3 for compressor designs B, C and D. Accordingly, the present invention provides a compressor designer greater latitude in tailoring a surge line profile for a particular design application.

Referring now to FIG. 6, a table shows selected characteristics of various compressor designs A–H discussed above. The table of FIG. 6 reflects characteristics taken from compressor maps for the various designs for a single compressor total pressure ratio, namely 2.0:1.0. Note that the data presented in FIG. 6 is calculated at a 68% efficiency level at choke. The various columns are as follows: For the first vent column 601, $\alpha_1$ and $\beta_1$ are listed; and for the second vent column 604, $\alpha_2$ and $\beta_2$ are listed. The choke/surge ratio column 605, the choke/spine ratio column 606, the spine/surge ratio column 607, the choke flow column 608, the surge flow column 609, the change in mass flow between the choke line and surge line (or, the map width) column 610, and the percent improvement in flow range column 611 are all listed. Spine is defined as an imaginary line passing through the center of the highest island of efficiency and at a 2.0:1.0 pressure ratio on a compressor map. Note that in percent improvement column 611, the test of design D having no slots, is used as the base line, and accordingly, the percent improvement is not applicable. However, compressor embodiment A performed with a 36.2% improvement in flow range over compressor design D. Embodiments E and G also experienced significant improvements in flow range, and even experienced higher percentage improvements than single vent designs, such as design B. Accordingly, the present invention provides improved flow range, or map width, over prior devices.

Note that the various devices tested, as reflected in FIGS. 3–6, were tested at the following standard conditions: p=95.70 kPa; t=302.6° K.(29.4° C.); and with the following correction factors: $\theta = T_1/302.6°$ K,; and $\delta = P_1/95.7$ kPa.

Referring now to FIG. 2, a second embodiment of the present invention is partially shown. The turbocharger of FIG. 2 is shown as being the same as that illustrated in FIG. 1, except for the location and arrangement of the first vent and the second vent. More specifically, first vent 259 and second vent 261 are slanted. For example, second vent 261 is slanted from an upstream position 271 on external shroud surface 53 back to a downstream position 273 on internal shroud surface 49. Note that position 273 of the opening of second vent 261 is located upstream of datum 100 (and upstream of leading edge 43). Accordingly, the value of $\alpha_2$ for second vent 261 would be negative. The effective width of the vents is taken on an angle as illustrated with effective vent width $W_3$ for first vent 259.

In the embodiment of FIG. 2, it is preferred that first vent 259 and second vent 261 comprise circumferential slots having a frustoconical geometry. However, as with the device illustrated in FIG. 1, these vents may comprise bores or other apertures. It is believed that the vent structure illustrated in FIG. 2 provides for more streamlined gas flow for recirculation from the impeller to venting chamber 57.

Figure 7:
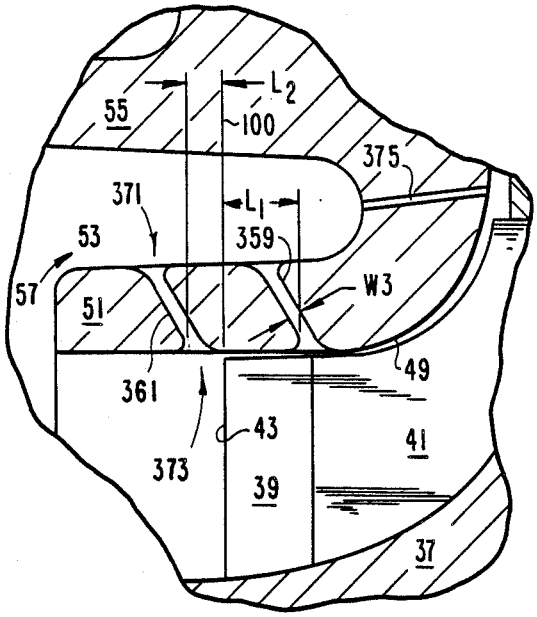
FIG. 7 is a partial side, cross sectional view of a third embodiment of a turbocharger having a compressor stage according to the present invention.

Referring now to FIG. 7, a third embodiment of the present invention is partially shown. The turbocharger of FIG. 7 is shown as being the same as that illustrated in FIG. 2, except that slots 359 and 361 have aerodynamic inlets and outlets, and a third vent 375 is provided. Aerodynamic inlets and outlets, such as at 373 and 371 provide for smoother air flow through the vents by having smooth, curved surfaces continuously between the inner surface of the vent and internal shroud surface 49. Vent 375 may be a slot or set of holes connecting venting chamber 57 to the diffuser face. Part of the reverse flow in the diffuser face passes through slot 375. This then makes the diffuser more efficient and thus increases compressor stage efficiency.

The present invention may also be practiced conceivably with even more than three vents. Also, in the illustrated embodiments, it is believed that flow through the first vent and the second vent can be simultaneously outward during surge, or can be simultaneously inward during choking.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A gas compressor stage comprising:

an impeller including a blade, said blade having a leading edge, an outward free edge and a trailing edge;

means for driving said impeller;

a compressor housing having a gas intake and a gas diffuser passageway downstream thereof, said impeller being located in said housing along a gas flow path between said gas intake and said gas diffuser passageway, wherein said housing includes a shroud wall upstream of said gas diffuser passageway and having an internal shroud surface in close proximity to said radially outward free edge of said blade;

a first vent in said shroud wall being located in said shroud wall upstream of said trailing edge of said impeller; and a second vent in said shroud wall being located in said shroud wall upstream of said first vent, wherein said impeller further includes a hub and defines a meridional path between said hub and said radially outward free edge, wherein said meridional path intersects with said leading edge of said impeller to define a meridional datum, wherein said meridional path intersects with said trailing edge to define a high pressure datum, and wherein said first vent is located between said meridional datum and said high pressure datum.

2. The compressor stage of claim 1 and further comprising an outer shroud annularly positioned around said shroud wall and defining a venting chamber therebetween, said first vent and said second vent communicating with said venting chamber.

3. The compressor stage of claim 2 wherein said second vent is located between said meridional datum and said high pressure datum.

4. The compressor stage of claim 3 wherein said first vent comprises a first circumferential slot around said shroud wall and having struts thereacross.

5. The compressor stage of claim 4 wherein said second vent comprises a second circumferential slot around said shroud wall and having struts thereacross.

6. The compressor stage of claim 5 wherein said first vent slants from an upstream position at an external shroud surface to a downstream position at said internal shroud surface.

7. The compressor stage of claim 6 wherein said second vent slants from an upstream position at an external shroud surface to a downstream position at said internal shroud surface.

8. The compressor stage of claim 8 and further comprising a third vent in said shroud wall downstream of said first vent and providing venting from said diffuser passageway outside of said shroud wall.

9. The compressor stage of claim 2 wherein said second vent is located near said meridional datum.

10. The compressor stage of claim 1 wherein said second vent is located upstream of said meridional datum.

11. The compressor stage of claim 1 wherein said first vent is located at a point from 25 to 35% of the distance from said meridional datum to said high pressure datum along said internal shroud surface.

12. The compressor stage of claim 11 wherein said second vent is located at a point from −5 to 15% of the distance from said meridional datum to said high pressure datum along said internal shroud surface.

13. The compressor stage of claim 1 wherein said first vent is located at a point about 30% of the distance from said meridional datum to said high pressure datum along said internal shroud surface.

14. The compressor stage of claim 1 wherein said second vent is located at a point from −5 to 15% of the distance from said meridional datum to said high pressure datum along said internal shroud surface.

15. The compressor stage of claim 1 wherein said first vent and said second vent allow upstream venting from said gas flow path, outwardly through said shroud wall, and into said gas intake.

16. A turbocharger having a gas compressor stage comprising:

an impeller including a hub, a blade, said blade having a leading edge, an outward free edge and a trailing edge;

turbine means operably couplable to an exhaust of an internal combustion engine for driving said impeller;

a compressor housing having a gas intake and a gas diffuser passageway downstream thereof, said diffuser passageway being operably couplable to an air intake of said internal combustion engine, said impeller being located in said housing along a gas flow path between said gas intake and said gas diffuser passageway, wherein said housing includes a shroud wall upstream of said gas diffuser passageway and having an internal shroud surface in close proximity to said radially outward free edge of said blade, wherein said impeller defines a meridional path between said hub and said radially outward free edge, wherein said meridional path intersects with said leading edge of said impeller to define a meridional datum, and wherein said meridional path intersects with said trailing edge to define a high pressure datum;

first venting means in said shroud wall for allowing gas flow through said shroud wall, said first venting means being located in said shroud wall upstream of said high pressure datum; and second venting means in said shroud wall for allowing gas flow through said shroud wall, said second venting means being located in said shroud wall upstream of said first venting means.

17. The turbocharger of claim 16 wherein said first venting means and said second venting means allow upstream venting from said gas flow path, outwardly through said shroud wall, and into said gas intake.

18. A gas compressor stage comprising:

an impeller including a hub, a blade, said blade having a leading edge, an outward free edge and a trailing edge;

means for driving said impeller;

a compressor housing having a gas intake and a gas diffuser passageway downstream thereof, said impeller being located in said housing along a gas flow path between said gas intake and said gas diffuser passageway, wherein said housing includes a shroud wall upstream of said gas diffuser passageway and having an internal shroud surface in close proximity to said radially outward free edge of said blade, wherein said impeller defines a meridional path between said hub and said radially outward free edge, wherein said meridional path intersects with said leading edge of said impeller to define a meridional datum, and wherein said meridional path intersects with said trailing edge to define a high pressure datum, said impeller defining an inducer diameter at said meridional datum and an outer diameter at said high pressure datum;

first venting means in said shroud wall being located in said shroud wall upstream of said high pressure datum, wherein said first venting means has a first effective vent width and is located a first meridional vent distance from said meridional datum, wherein the ratio between said first meridional vent distance and said outside diameter is between 0.01:1.00 and 0.15:1.00, and wherein the ratio between said first effective vent width and said inducer diameter is between 0.01:1.00 and 0.05:1.00; and second venting means in said shroud wall for allowing gas flow through said shroud wall, said second venting means being located in said shroud wall upstream of said first venting means, wherein said second venting means has a second effective vent width and is located a second meridional vent distance from said meridional datum, wherein the ratio between said second meridional vent distance and said outside diameter is between −0.04:1.00 and 0.015:1.00, and wherein the ratio between said second effective vent width and said inducer diameter is between 0.01:1.00 and 0.04:1.00.

19. The compressor stage of claim 18 wherein the ratio between said first meridional vent distance and said outside diameter is between 0.0139:1.000 and 0.1111:1.000.

20. The compressor stage of claim 19 wherein the ratio between said first effective vent width and said inducer diameter is between 0.020:1.000 and 0.040:1.000.

21. The compressor stage of claim 20 wherein the ratio between said second meridional vent distance and said outside diameter is between −0.0343:1.0000 and 0.0139:1.0000.

22. The compressor stage of claim 21 wherein the ratio between said second effective vent width and said inducer diameter is between 0.020:1.00 and 0.030:1.000.

23. The compressor stage of claim 18 wherein the ratio between said first effective vent width and said inducer diameter is between 0.020:1.000 and 0.040:1.000.

24. The compressor stage of claim 18 wherein the ratio between said second meridional vent distance and said outside diameter is between −0.0343:1.0000 and 0.0139:1.0000.

25. The compressor stage of claim 18 wherein the ratio between said second effective vent width and said inducer diameter is between 0.020:1.00 and 0.030:1.000.

26. The compressor stage of claim 18 wherein the ratio between said first meridional vent distance and said outside diameter is about 0.11:1.00, and wherein the ratio between said first effective vent width and said inducer diameter is about 0.03:1.00, wherein the ratio between said second meridional vent distance and said outside diameter is about 0.014:1.00, and wherein the ratio between said second effective vent width and said inducer diameter is about 0.02:1.00.

27. The compressor stage of claim 18 wherein the ratio between said first meridional vent distance and said outside diameter is about 0.06:1.00, and wherein the ratio between said first effective vent width and said inducer diameter is about 0.04:1.00, wherein the ratio between said second meridional vent distance and said outside diameter is about −0.03:1.00, and wherein the ratio between said second effective vent width and said inducer diameter is about 0.03:1.00.

28. The compressor stage of claim 18 wherein said first venting means comprises a circumferential slot having an aerodynamic inlet and an aerodynamic outlet.

29. The compressor stage of claim 18 and further comprising an outer shroud annularly positioned around said shroud wall and defining a venting chamber therebetween, said first venting means and said second venting means communicating with said venting chamber.

30. The compressor stage of claim 18 wherein said first venting means and said second venting means allow upstream venting from said gas flow path, outwardly through said shroud wall, and into said gas intake.

* * * * *

UNITED STATES PATENT AND TRADEMARK OFFICE

CERTIFICATE OF CORRECTION

PATENT NO. : 4,930,978

DATED : June 5, 1990

INVENTOR(S) : Jai K. Khanna, Norman G. Silvey and Charles D. Williams

It is certified that error appears in the above-identified patent and that said Letters Patent is hereby corrected as shown below:

At column 3, line 18, after the phrase "located in the" please insert the word --shroud--.

At column 9, line 46, "claim 8" should read "claim 7".

Signed and Sealed this

First Day of October, 1991

*Attest:*

*Attesting Officer*

HARRY F. MANBECK, JR.

*Commissioner of Patents and Trademarks*